United States Patent [19]

Speranzin et al.

[11] Patent Number: 4,577,459

[45] Date of Patent: Mar. 25, 1986

[54] PROCESS AND APPARATUS FOR MECHANICALLY SPLICING YARNS

[75] Inventors: Claudio Speranzin; Roberto Badiali, both of Pordenone; Luciano Bertoli, Salo', all of Italy

[73] Assignee: Officine Savio S.p.A., Pordenone, Italy

[21] Appl. No.: 438,805

[22] Filed: Nov. 3, 1982

[30] Foreign Application Priority Data

| | | | |
|---|---|---|---|
| Nov. 4, 1981 | [IT] | Italy | 83494 A/81 |
| May 26, 1982 | [IT] | Italy | 83396 A/82 |
| May 26, 1982 | [IT] | Italy | 83397 A/82 |
| Sep. 13, 1982 | [IT] | Italy | 83447 A/82 |

[51] Int. Cl.[4] ..... B65H 69/06; D01H 15/00

[52] U.S. Cl. ..... 57/22; 57/202; 57/261

[58] Field of Search ..... 57/22, 23, 202, 261, 57/262, 263

[56] References Cited

U.S. PATENT DOCUMENTS

| | | | |
|---|---|---|---|
| 1,345,375 | 7/1920 | Lemay | 57/22 |
| 1,463,401 | 7/1923 | Pearson et al. | 57/22 |
| 1,572,655 | 2/1926 | Pearson et al. | 57/22 |
| 1,950,658 | 3/1934 | Cavanagh et al. | 57/22 |
| 2,028,144 | 1/1936 | Cavanagh | 57/22 |
| 2,362,801 | 11/1944 | Charnock | 57/22 |
| 2,515,172 | 7/1950 | Abbott | 57/22 |
| 2,605,603 | 8/1952 | Willis | 57/202 |
| 3,307,339 | 3/1967 | Porter | 57/22 |
| 3,379,002 | 4/1968 | Rosenstein | 57/22 X |
| 3,633,352 | 1/1972 | Marriner | 57/22 |
| 4,240,247 | 12/1980 | Matsui et al. | 57/202 |
| 4,341,065 | 7/1982 | Baumgartner et al. | 57/202 X |
| 4,341,066 | 7/1982 | Baumgartner | 57/202 X |
| 4,386,494 | 6/1983 | Felix | 57/22 |
| 4,407,117 | 10/1983 | Garnsworthy | 57/22 |

FOREIGN PATENT DOCUMENTS

| | | |
|---|---|---|
| 646976 | 8/1964 | Belgium . |
| 889501 | 11/1981 | Belgium . |
| 889502 | 11/1981 | Belgium . |
| 889503 | 11/1981 | Belgium . |
| 0039609 | 11/1981 | European Pat. Off. . |
| 250226 | 10/1912 | Fed. Rep. of Germany . |
| 1919149 | 10/1969 | Fed. Rep. of Germany . |
| 3029431 | 3/1982 | Fed. Rep. of Germany . |
| 3029452 | 3/1982 | Fed. Rep. of Germany . |
| 3114160 | 10/1982 | Fed. Rep. of Germany . |
| 50395A | 9/1979 | Italy . |
| 376918 | 7/1932 | United Kingdom . |
| 661697 | 11/1951 | United Kingdom . |
| 2026555 | 2/1980 | United Kingdom . |
| 2083090 | 3/1982 | United Kingdom . |

*Primary Examiner*—John Petrakes

*Attorney, Agent, or Firm*—Stevens, Davis, Miller & Mosher

[57] ABSTRACT

A procedure for splicing textile yarns mechanically whereby two yarns which are initially placed crosswise, awry or parallel to each other are first untwisted and then retwisted together by two rings, the rings being placed face to face and opposite to each other and act on yarns positioned between the rings, and whereby the excessive tail ends are eliminated and the yarns are untwisted up to a desired value in positions of mutual non-interference and are then brought together until they are substantially pressed against each other and are clamped at a position lying at about the beginning of the desired taper of each remaining tail end in cooperation with the rings so as to determine the length of the remaining tail ends and to effect a plucking/tearing action on the tails to be discharged, thereby obtaining progressive remaining tail ends before the retwisting action, and whereby the remaining tail ends are doubled and retwisted at least by the rings, which control the tail ends in at least two points located at least at about the ends of the splice.

A splicer device for splicing textile yarns mechanically having two rings facing each other, whereby at least one ring is movable in relation to the other and two yarns to be spliced are positionable between the rings, and whereby the yarns undergo a controlled untwisting action and a controlled retwisting action and also an intermediate action of removal and discharge of their excessive tail studs to bring the yarns together, an intermediate clamp cooperating with a plucking and tearing element, a retwisting element, and a drive cam.

38 Claims, 21 Drawing Figures

PROCESS AND APPARATUS FOR MECHANICALLY SPLICING YARNS

This invention relates to a procedure for splicing textile yarns mechanically, and also a splicer device which is suitable for splicing textile yarns mechanically according to said procedure.

More particularly, this invention relates to a procedure and a device suitable for splicing two yarns together by undoing and then re-constituting the twists in the textile yarns, the whole being carried out mechanically.

Splicer devices working by air are known which employ a turbulence chamber wherein the fibers of the yarns are separated and mingled, so that the yarns are thereafter spliced together.

Mechanical splicer devices of a type making fisherman's knots or knots of another kind are also known.

Mechanical splicer devices are known which undo the yarns by rolling them between two elements which rotate, roll or slide against each other in opposite directions.

With this type of splicer device the yarns are untwisted advantageously within well defined zones by the pairs of elements.

Thus U.S. Pat. No. 3,633,352 envisages the mutual penetration and mutual anchorage of fibers already arranged parallel to each other and separated by means of oscillating surfaces, but the system can be employed for processing, not textile yarns, but only slivers having fibers already substantially parallel wherein it is not necessary to impart twists nor to control, to more than a given degree, the tract to be connected.

U.S. Pat. No. 3,307,339 envisages the untwisting of yarns, the tearing of excessive tail ends with the remaining tails left suspended in the air, the coupling of the remaining tails and then the retwisting of the yarns thus coupled.

To enable the tails to be coupled and retwisted, U.S. Pat. No. 3,307,339 uses a stationary comb that should uphold and bring together the tails which would otherwise fly about.

However, the retwisting action becomes problematical and uncertain since, if retwisting is to take place, it presupposes that the tails are truly anchored together.

But the anchorage cannot be obtained strong enough because it is attempted merely by the static pressure of the comb.

The static pressure of the comb also causes a delay in the imparting of the twist and, above all, does not ensure that the twist is applied in the right degree to both the tail ends and on the tail ends.

If splicing does take place, it is produced between some peripheral fibers which, if they do remain, may possibly then set the rest of the fibers in rotation, but such a result is not certain in any event, considerable tails remain free and the splice is made on a small tract.

GB No. 661,697 envisages a method for forming a splice which is in itself generic and can be made by hand, but it is impossible to understand how it can be done by machine.

Moreover, the detail shown in FIG. 4 thereof is technically incapable of being brought about since the addition of two yarns gives, not the thickness of only one yarn, but the thickness of one and a half yarns or more.

Furthermore, it is impossible to understand how to apply the twists or to couple the yarns and apply the retwisting, etc. The invention is too generic to be capable of being adapted and applied industrially.

EP No. 81301964.3 is also known which envisages a device and method to splice two twisted yarns by untwisting portions of each yarn, tearing said portions from the yarn so as to form two tail ends, coupling the tail ends and retwisting the tail ends so as to form a splice, wherein the yarn is clamped at gripping points spaced apart to define a specific tract of yarn to be untwisted, whereby the specific untwisted tract stays locked between the distanced gripping points even after formation of the tail ends, and whereby at least part of the tail ends cooperates with at least two of the distanced gripping points.

The present invention relates specifically to the undoing and reconstitution of the yarns of unrolling and re-rolling the yarns between surfaces moving in opposite directions, whereby the surfaces are able to control at least the ends of each tract to be spliced.

The present invention also employs auxiliary participating means cooperating with the surfaces.

Hereinafter in the description, for the sake of simplicity and straightforwardness, an embodiment will only be dealt with, which consists of facing rings, but the rings can be replaced with pairs of blocks, tapes, pairs of small rings substantially and at least momentarily coaxial with the yarn or other like means which could in fact be employed for the purpose.

Mechanical splicer devices of a known type which are suitable for controlling the tracts to be spliced and with which the present invention is concerned entail noteworthy drawbacks, above all with regard to the nature of the splice and the unwound end tuft of the tail and lastly as regards the consistency and composition of the knot itself.

The joints are obtained by untwisting the yarns to a desired value, coupling them in an untwisted state and then retwisting the coupled yarns so that the fibers of one yarn are associated with the fibers of the other yarn.

Instead, the present invention has the purpose advantageously of obtaining degrees of untwisting which range from the attainment of parallel or substantially parallel fibers at the end of untwisting to the attainment of a negative twist the same as or even greater than the positive twist originally comprised in the yarn, at least in the tract to be spliced.

Untwisting and retwisting means the respective operations which remove the twists present in a yarn and which reconstitute the twists.

Untwisting shall mean hereinafter, therefore, an action of eliminating the twists even up to about a nil value or beyond the value, or else perhaps until a degree of negative twist has been imparted which is the same as or greater than the initial positive twists.

Retwisting shall mean the operation of reconstituting the twists in the spliced yarn, whereby the twists at the end of retwisting may be the same as, or almost the same as, or greater than, the original twists.

The procedure proposed and the device connected therewith enable a quick, clean joint to be obtained without end tufts and also enable a stable and strong joint to be obtained which is, in any event, able to ensure a tensile strength at least the same as that of the rest of the yarn.

According to the invention the yarns are advantageously, but not necessarily, parallel between the facing ring means at the beginning of the procedure, but they can also be positioned crosswise to each other or awry.

The ring means which face one another have friction surfaces able to apply a tangential force to the yarn when the ring means are at least resting against the yarns with a desired pressure and are set in rotation.

The yarns are inserted between the facing ring means of the splicer device by means which are already known and therefore do not constitute part of the invention. The ring means are then brought towards each other until they come into contact with the fibers with a desired pressure, and are then made to rotate in opposite directions to each other, and both of them in a direction opposite to that of the winding of the yarns, so that a negative twist of a desired degree and value is generated in the yarn themselves.

When the desired degree of negative twist in the yarns has almost been obtained or has been obtained, steps are taken to bring the yarns together so that they come substantially into contact with and are substantially parallel to each other, one of them perhaps being pushed advantageously against the other.

When the yarns are in contact, and after they have come into contact, with each other, an auxiliary separation of the fibers with auxiliary participation means may be brought about.

The auxiliary separation may take place as a result of the action of suitable means such as combs, jets of a cold liquid, jets of a hot liquid, jets of a treated liquid or treatment liquid, brushes, needles or other like or mixed means.

The auxiliary participation means cooperate advantageously within the tract comprised between the inner peripheries of the ring means.

Besides the action of the outer ring means, the procedure requires the action of retwisting means cooperating with the inside of the ring means.

The outer profile of the ring means, or even of the means containing and holding the ring means, can be shaped in a differentiated way along their circumference.

The ring means and retwisting means are lined with a substance which has a desired coefficient of friction in relation to the yarn.

The substance will have advantageously a relatively or very low coefficient of friction in relation to itself.

Both the ring means and the retwisting means may have special designs placed on them, at least on their surfaces, and possible shallow recesses so as to strengthen the effects of their action.

Next, the procedure includes, in possible cooperation with the ring means, means which apply a sideways pulling action and can act on the yarn by moving it sideways and, in relation to the center of rotation, specifically on one side and the other of said center so as to cause the mutual coupling of the untwisted yarns, as said earlier.

Then the procedure provides advantageously means to lock the imparted negative twists during intermediate phases of the procedure during which the negative twists might be lost at least partially.

The ring means and retwisting means are able to be brought near to each other and to interact against one another with a desired pressure which may be varied on a time basis according to requirements which can be predetermined.

The pressure exerted on the ring means and retwisting means can be mechanical, elastic or mixed but will be set and be advantageously capable of being set to suit the specific splicing requirements.

According to the invention the untwisting action can be applied for a more or less short time so as to obtain the desired degree of negative twist in the yarns.

As previously stated, the degree of untwisting may lead to the obtaining of a value of negative twist of about nil (the fibers will be substantially parallel at the end of untwisting in this case) but may also lead to the obtaining of a value of untwisting of at least about a negative twist (as opposed to the positive starting twist) equal to or almost equal to the values of the initial positive twist or to intermediate values.

The regulation of the untwisting action is carried out with means for regulating the untwisting or negative twist.

According to the invention the regulation can retain its effects also during the retwisting phase (re-constitution of the initial twists), or can be varied as wished so as to obtain a greater or lesser or fixed or adjustable or variable effect.

According to the invention the plucking apart and tearing action is carried out by plucking and tearing means which may consist of grippers, levers, suction intakes or means thereamong acting jointly.

During the plucking and tearing phase the reciprocal position existing between the yarns, ring means and retwisting means (also in relation to their mutual conformation) may be such as to provoke in the yarns common untorn tracts, whether coinciding with each other or not, or else to produce two progressively diminishing tail ends in the yarns, or else intermediate values.

The device may be coupled to levers or means to extract or expel the spliced yarn if the means are not comprised in the usage equipment to which the device is fitted and if the splicer device does not lie on the same axis as the processing of the yarn during the phase of normal use.

According to the invention the resultant device can be made to cooperate with an electronic slub catcher. In such a case the device will be located in a position substantially below the slub catcher. The lower position may be mutual side-by-side positioning or mutual in-line positioning.

If the splicer device of the invention is made to cooperate with an electronic slub catcher of the normal type employed to control the yarn (and therefore not of the special type used to control the knots), the resultant splice, being equiparable to the yarn, is controlled efficiently at once.

According to the invention a suitable lever to control swinging of the yarn may cooperate with the splicer device and slub catcher and be able to hinder the jolting of the yarn in the slub catcher and therefore prevent a wrong intervention of the latter.

According to the invention the retwisting means consist of flat retwisting means, or specially designed or specialized retwisting means with sectors or eccentric disks with one single center or with two centers staggered along a diameter or with a double spiral or else combinations thereof.

One retwisting means may cooperate with another having the same specialization or with another having a different specialization, which may also be at least partly flat.

The specialized retwisting means comprise suitable ridges constituting processing means able to act on the yarn.

The processing means comprised on the retwisting means, for instance with a double spiral, have a width which, after a given angle of rotation of the retwisting means, allows the part of the yarns previously covered by the processing means to be freed and to lie in between two processing means. The freeing can take place in steps or be progressive.

The action of the processing means permits a continuous, gradual re-rolling action working progressively along the axis of the yarn on the yarn itself, with a substantially lengthwise action that goes from the middle of the ring, that is, from the substantial center of the joint towards its outside edge in an even, progressive manner.

The pressure exerted on the yarns by the retwisting means has the effect that a mechanical concentration of the fibers takes place and also enables the hairiness of the yarns to be amalgamated with the fibers, thus providing a better bond, amongst other things.

Flat retwisting means may be included instead of the specialized retwisting means or in cooperation therewith, as stated earlier.

According to the invention, in a possible combination of the retwisting means the means may be paired so as to include flat or partially flat retwisting means in cooperation with one unrolling/re-rolling ring means, whereas the other unrolling/re-rolling ring means may be accompanied, for instance, by retwisting means having two opposed spirals or of another type.

According to the invention the sizes of one ring means and one retwisting means working on one side may be the same as or different from the sizes of the other ring means and other retwisting means working on the other side.

It is possible for suitable auxiliary particiation means to stabilize the jointed tract, whereby the means exert a heating action which may be provided in various ways, for instance, with microwaves, electrostatic or dielectric charges, heated or radiant plates, electrical discharges, etc., the means employed to generate the desired heating action not being relevant with regard to the economics of the invention.

The heating, which may range from 60° C. to 130°/150° C., depending on the yarn, enables any tension in the fibers or body of the splice to be relaxed and their reciprocal positions to be fixed.

As said before, the retwisting means can be specialized in various ways and can comprise auxiliary elements needed to carry out the functions required by the procedure.

Thus, one retwisting means may also comprise intermediate clamping means consisting, for instance, of a suitable modification of the processing means or else, or also, consisting of a material that yields at least partially in a different way owing to the pressure exerted between the retwisting means themselves.

According to a variant the intermediate clamping means consisting of a ring which is within the outer ring means and is movable axially in relation to the outer ring and to the retwisting means.

The auxiliary participation means may also be comprised in the retwisting means.

Moreover, the processing means of the retwisting means may be of various types and various shapes and sizes and thereby can be specialized differently.

The processing means of the retwisting means will advantageously be made of a material suitable for applying considerable friction to the yarn itself so as to avoid unwanted sliding or displacement but a low reciprocal friction, advantageously, when one means is sliding and is pressed against the other.

The action of reciprocal pressure as between the ring means or between the retwisting means or between both of the means may, in any event, be such as to overcome by progressive elastic yielding the possibly greater height of the intermediate clamping means when the latter means are provided in continuation of or in cooperation with the processing means of the retwisting means.

The sizes and characteristics of the ring means and retwisting means can be varied to suit the properties of the fibers composing the yarns to be spliced.

According to the invention the intermediate clamping means can also be made movable independently of the remaining part of the retwisting means and, has been said, may consist, for instance, of intermediate clamping rings which are actuated by auxiliary lever or jack means, or can possess an elastic differentiated yielding, or may consist of other means that can be employed for the purpose.

According to the invention the reciprocal movement as between the ring means and as between the ring means and retwisting means can be the same (that is, can have the same angular speed if they are circular) or can be different or differentiated.

in the same way, according to the invention the speeds of the ring means and retwisting means can stay constant or can vary during the various phases which enable the procedure to be fulfilled.

It is within the spirit of the invention to utilize pulsating speeds.

The invention therefore defines a procedure for splicing textile yarns mechanically whereby two yarns which are initially placed crosswise, awry or parallel to each other are first untwisted and then retwisted together by two ring means, or by the mechanical equivalents thereof, facing each other and acting on the yarns positioned between the rings, and whereby the excessive tail ends are eliminated, and whereby the yarns are untwisted in a position of reciprocal noninterference and are then brought up to each other until they are substantially pushed against each other and are clamped in a position located at about the beginning of the desired taper of each remaining tail end in cooperation with the ring means so as to determine the length of the remaining tail ends and to carry out a plucking-tearing action on the tails to be discharged, thereby producing progressive remaining tail ends before the retwisting action, and whereby the tail ends are coupled and retwisted by at least the ring means, which govern the tail ends in at least two points located at about the ends of the splice.

The invention therefore embodies a splicer device for splicing textile yarns mechanically which is able to carry out the procedure and comprises two opposed facing ring means, or the mechanical equivalents thereof, whereby at least one ring can be moved in relation to the other ring and two yarns to be spliced are placed between the rings, and whereby the yarns undergo a controlled untwisting action and a controlled retwisting action and also an action of removal and discharge of their excessive tails, the splicer device comprises means to bring the yarns together and couple them,
intermediate clamping means,
clamping and tearing means,
retwisting means, discharge means, auxiliary undoing means and heating means.

Other details and features of the invention will stand out from the description given below by way of non-limitative example and with reference to the accompanying drawings, in which:

FIGS. 1 and 2 respectively show front and back views of a device according to the invention;

Figure 9:
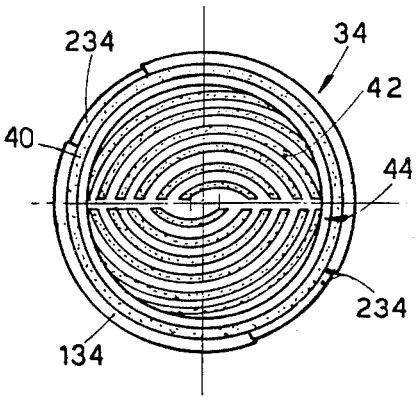
Figure 10:
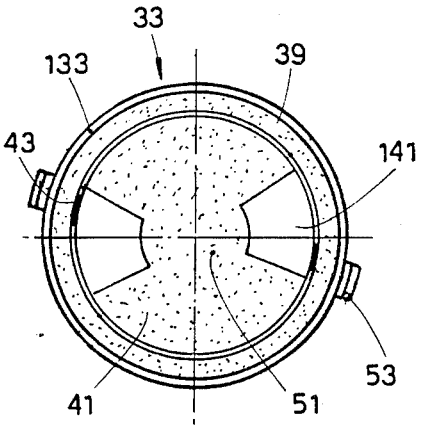
Figure 11:
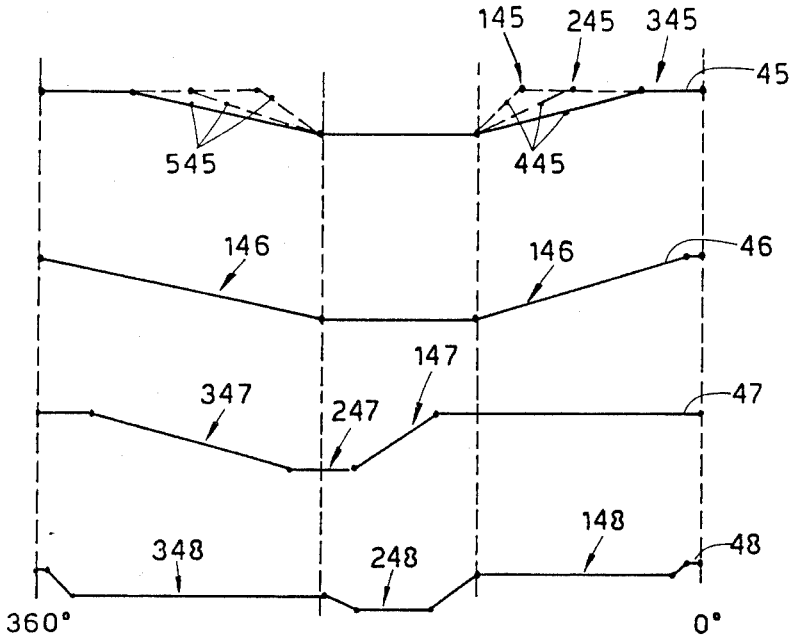
Figure 15A:
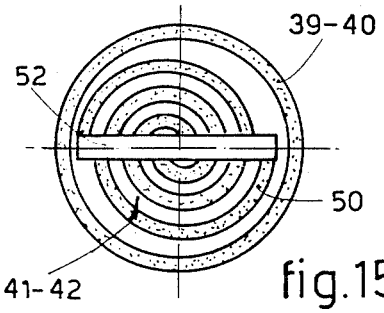
Figure 15C:
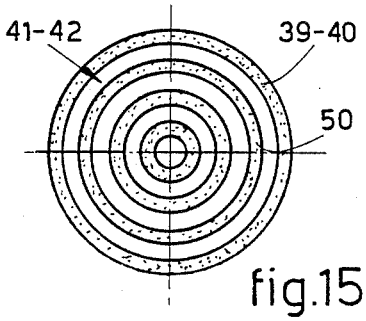
Figure 15B:
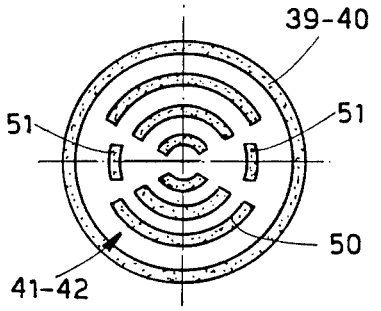
Figure 15D:
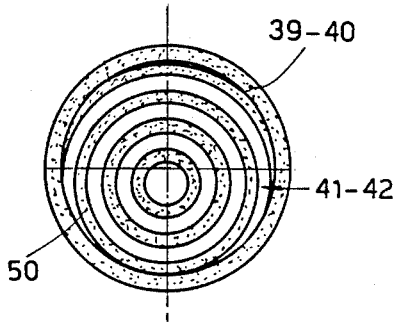
Figure 12:
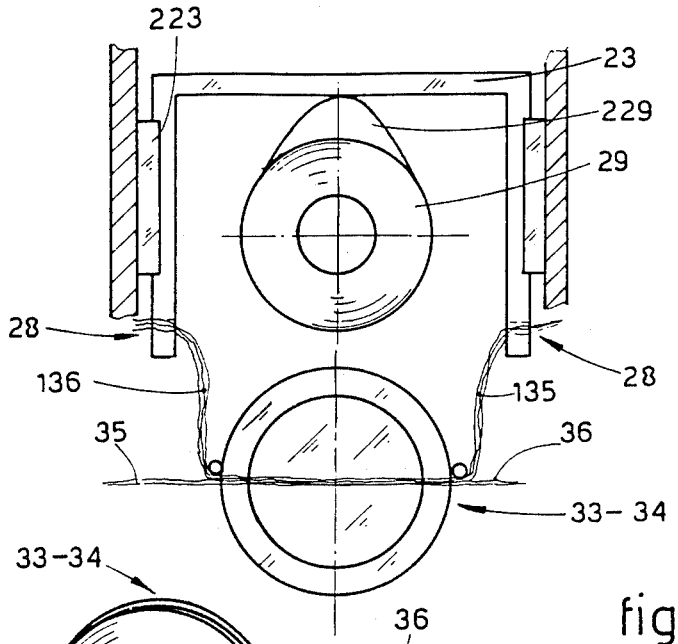
Figure 14:
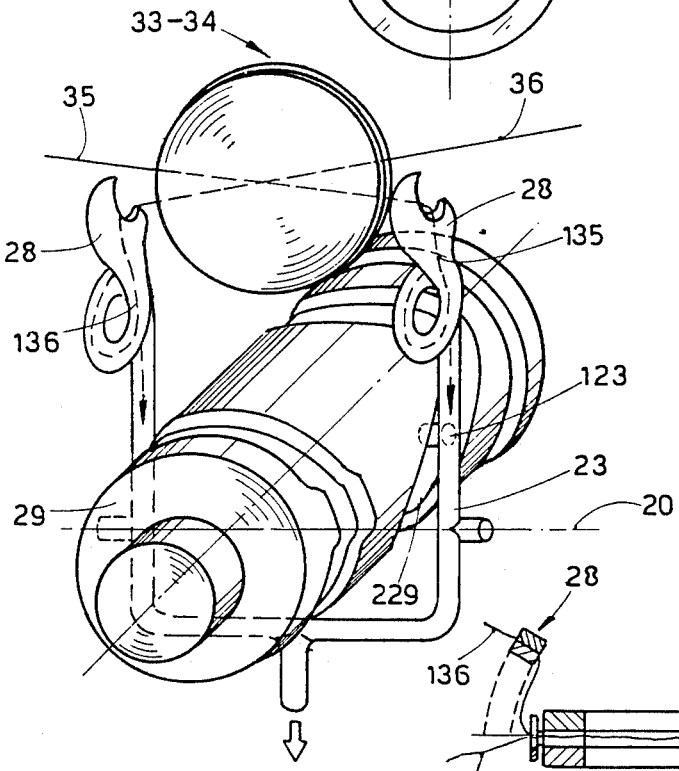
Figure 13:
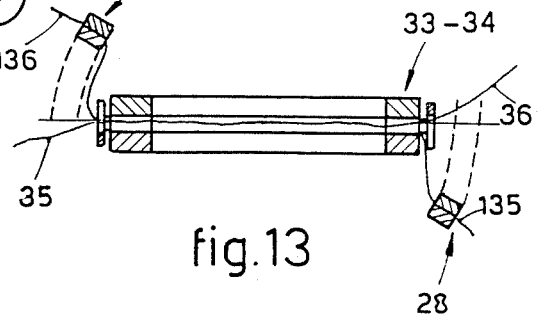

FIGS. 8*a*–8*d* show the reciprocal positions of the plate means bearing the ring means in three specific phases;

FIG. 9 gives a front view of a plate means;

FIG. 10 gives a front view of another plate means;

FIG. 11 shows the working cycle of the device;

FIGS. 12,13 and 14 show variants of the plucking and tearing means;

FIGS. 15*a*–15*d* show possible variants of the front conformation of the plate means.

With reference to the figures the same parts or parts performing the same functions bear the same reference numbers.

The splicer device 10 comprises a carrying frame 17, which in the figures is shaped substantially like a U and consists of a base 24 and two side members 217,317 on which the various components are fitted and positioned.

At its front and back the device comprises respectively the shields 11 and 111 and two supporting casings 14.

Figure 1:
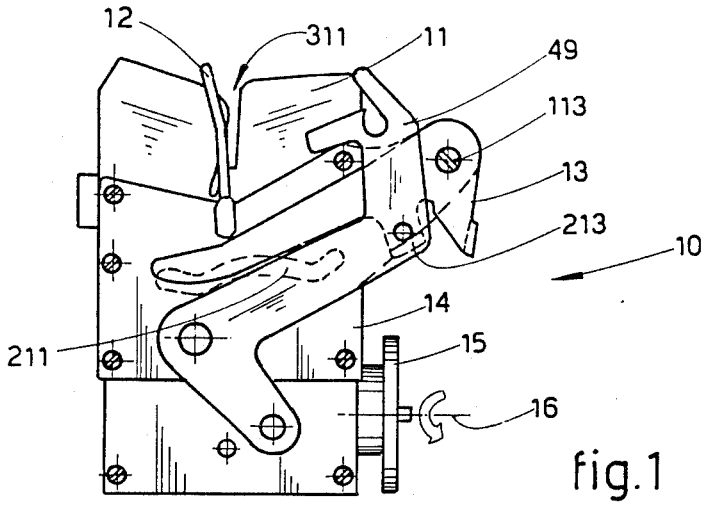
Figure 2:
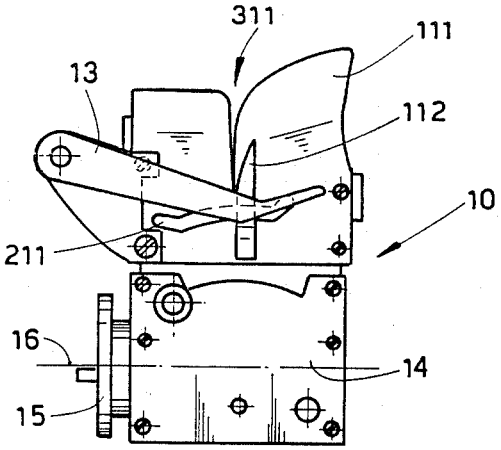

The shields 11,111 may consist of one single piece or several pieces and, in the lay-outs of FIGS. 1 and 2, comprise the cams 211 which serve to govern the locking means 28 in relation to the angular position of the plucking and tearing means 23 relative to the axis of oscillation 20.

The shields 11,111 have in their upper side the positioning notches 311, which are suitably shaped and serve to enable the two yarns 35 and 36 to be inserted into and positioned on the device 10.

Positioning rods 12 and 112 may cooperate with the positioning notches 311.

If the device 10 is not placed on the same axis as the normal working axis of the yarn, it may comprise expulsion means 13, which are lever means.

The expulsion means 13 may be within the device 10 and therefore advantageously actuated by the device itself or else may be outside the device and therefore capable of being actuated readily by the machine too to which the device 10 is fitted.

In FIGS. 1 and 2 the expulsion means 13 are outside and are positioned elastically and hinged at 113 and can be actuated by acting on 213.

A lever 49 to control swinging of the yarn may cooperate with the device 10 during normal working so as to avoid wrong actions by the electronic slub catchers.

The lever 49 is shaped in various ways and can be actuated in relation to the position of the device 10 as regards the working axis of the yarn in the electronic slub catcher.

The yarns 35,36 in the device 10 are inserted through the positioning notches 311 so as to be placed between the plate means 33 and 34, which are opened apart at the beginning of the splicing procedure, shown the yarns 35,36 lying substantially parallel.

The yarns 35,36 can be inserted either by movable arms or by air ducts or by the joint cooperation of such means, which are already known in themselves and comprised in the prior art of the machines to which the device can be fitted.

Figure 8D:
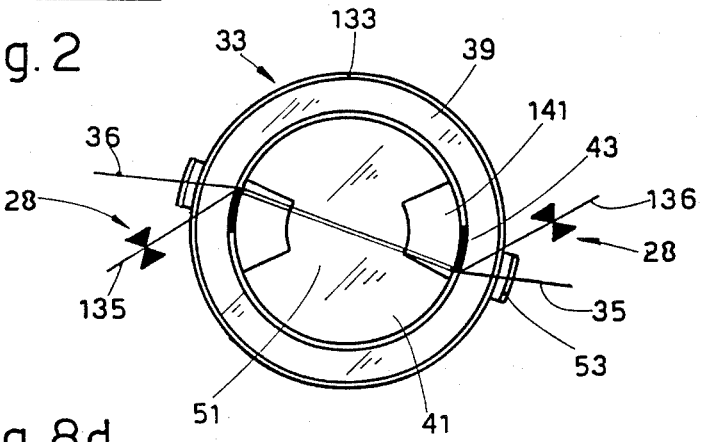
Figure 3:
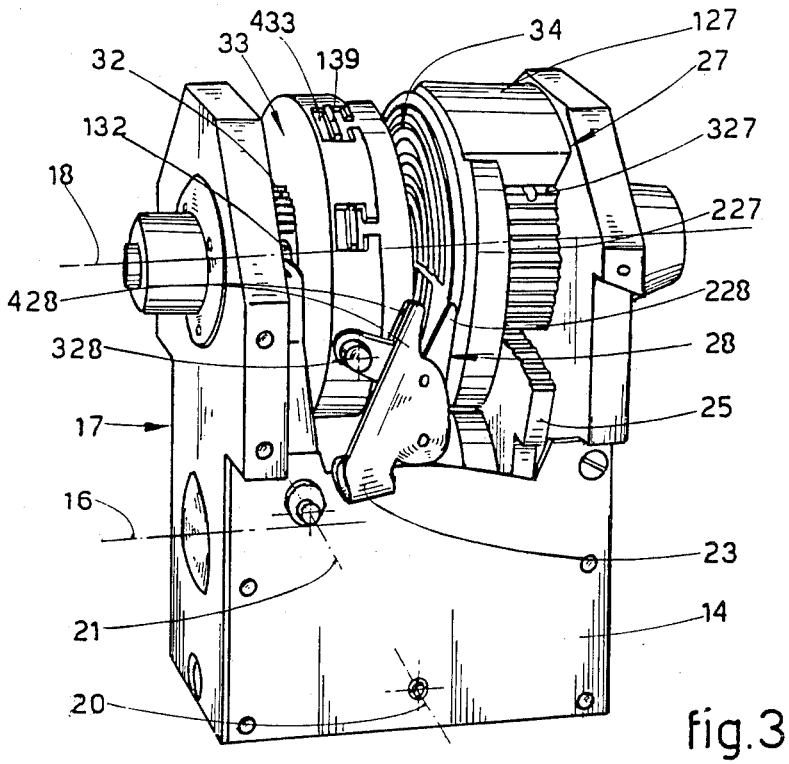
FIG. 3 shows the device of FIGS. 1 and 2 without the upper shields.
Figure 5:
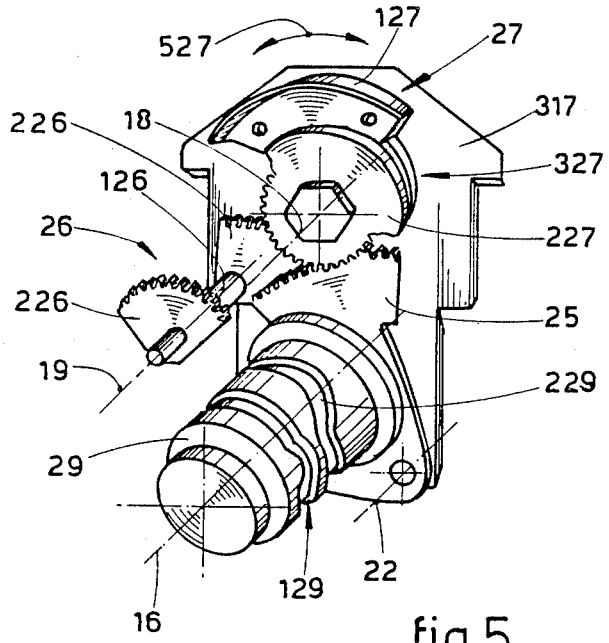
FIG. 5 shows a three-dimensional view of part of the device of FIG. 3.
Figure 8A:
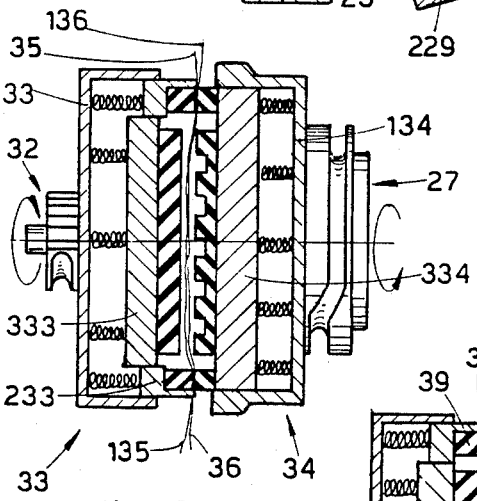
Figure 7:
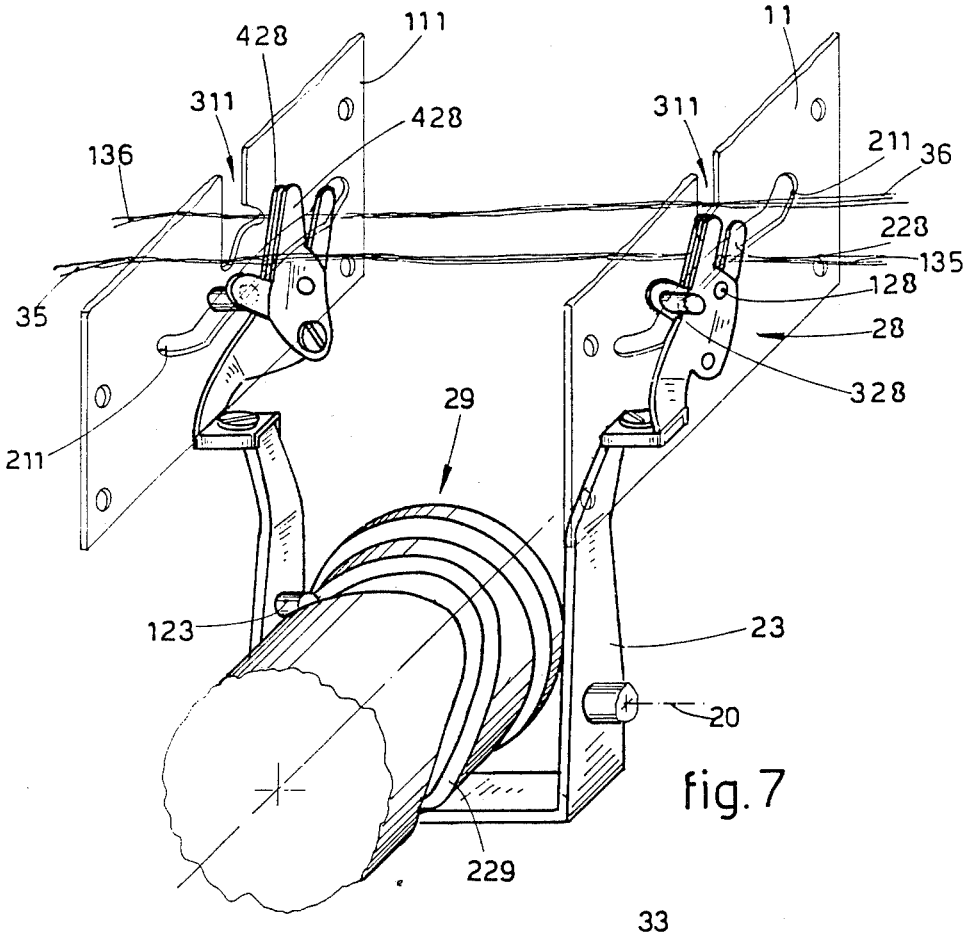
FIG. 7 shows a three-dimensional view of the plucking and tearing group.

In the present invention the yarns 35,36 are placed in continuation of each other, as shown in FIGS. 7 and 8*a*, but if so wished, could be positioned crosswise to each other or awry.

The motion arrives in a known manner with the desired characteristics through the motion-input wheel 15 with an axis of rotation according to 16.

The motion-input wheel 15 transmits rotation to a drive cam 29.

The drive cam 29 comprises three tracks or paths, which are respectively a path 129 for actuating the pressure of the plate means, a path 229 for actuating the tearing means and the third path 329 for actuating the rotation of the plate means.

Figure 6:
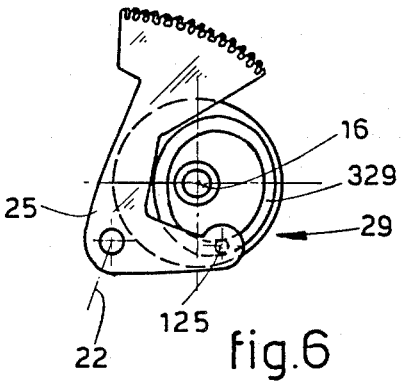
FIG. 6 shows the drive means for rotating the ring means.

The path 329 acts on the stud 125 (FIG. 6) of the lever 25 which rotates the plate means and which swings around the axis 22.

The lever 25 rotating the plate means meshes with the gear wheel 227 of the group which governs untwisting.

The gear wheel 227 than transmits the motion through the motion-transmission means 26 with an axle 19, here consisting of the small shaft 126 and toothed sectors 226, to the transmission gear wheel 31, which transmits the motion in its turn to the gear-wheel 32 solidly fixed to the movable plate, or movable plate means, 33, whereby the gear wheel 227 is solidly connected to the plate, or plate means, 34 governing untwisting.

The group 27 governing untwisting consists not only of the gear wheel 227 but also of a cam 327 which cooperates with a pin 127P solidly fixed to the selector 127.

The selector 127 can be fixed so as to rotate on the axis of the rings 18 at a desired point within a given angular displacement 527 by acting on the locking means 427.

Since the cam 327 is set in rotation together with the gear wheel 227, by displacing the selector 127 by an angle the moment of cooperation of the pin 127P with the lengthwise displacement of the path on the cam 327 is advanced or retarded.

As the pin 127P cannot be moved lengthwise, the cam 327 has to move, and therewith the gear wheel 227 and consequently the plate 34 have to move.

The selector 127 serves to determine the moment at which the plate, or plate means, 34 has to move lengthwise towards the plate means 33 so as to start the untwisting action on the single yarns 35 and 36, and also the moment at which the plate 34 has to withdraw to end the retwisting action on the spliced yarn 37.

The conformation of the cam 327 and action of the path 329 cause the plate means 34 to stay substantially still between the two moments at a specific lengthwise position as shown in the graph of FIG. 11.

If so wished, it is possible for a further lever which, by acting on the selector 127 in the retwisting phase, reduces or amplifies the retwisting action itself in relation to the untwisting action by displacing the selector 127 itself or the pin 127P.

The sequence of the gear wheels 227, 226, 31 and 32 has the effect that the plate means 34 rotates in the opposite direction to the plate means 33.

The path 129 serves to make the plate means 33 approach and to carry out all the reciprocal interactions between the plate means 33 and 34.

The path 129 acts on the stub 230 of the lever 30 swinging at 21 by means of the pivot 130.

The lever 30 acts with its stud 330 in the hollow 132 recessed for a stud, in cooperation with the gear wheel 32 solidly fixed to the plate means 33.

This enables the plate means 33 to move lengthwise on the axis 18 as a result of the conditionings provided by the path 129.

Figure 4:
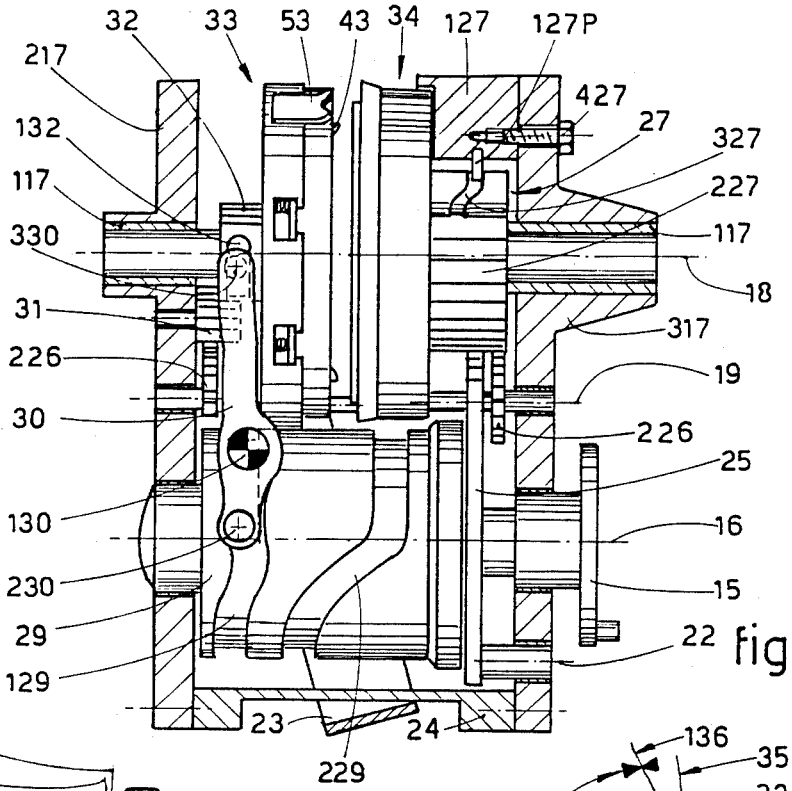
FIG. 4 shows the device of FIG. 3 partially sectioned vertically as desired.

In FIG. 4 the pivots of the plate means 33,34 can slide lengthwise in the sleeves 117 besides being able to rotate therein.

It can be seen from the foregoing how the device, by employing a drive cam 29, can obtain all the movements needed to carry out the procedure and make the splice.

Indeed, the path 229 acts on the drive stud 123, which moves by an angle the plucking and tearing means 23 swinging at 20.

The plucking and tearing means 23 comprise suitable means 28 to clamp the tail ends 135–136 of the respective yarns 35–36 to be plucked and/or torn.

The clamping means 28 may be gripper means (FIGS. 7, 12 and 13) or suction means (FIG. 14) or hook means or slit means or be of another kind.

The plucking and tearing means 23 may swing at 20, as has been said earlier, or slide on guides (in this case the path 229 will comprise a suitable swelling for the plucking and tearing action) or rotate as shown in FIG. 13.

If clamping means 28 with grippers are utilized, they will comprise advantageously two stationary levers 428 distanced apart so as to cooperate with a movable lever 228 swinging at 128 and actuated by the stud 328 conditioned by the cam 211 of the shield.

According to the figures, if the lever 228 is moved, it closes the yarn against the stationary levers 428.

The conformation of the cam 211 causes the grippers 28 to open in the position to receive the yarn and in the position when the plucking and tearing has already taken place.

If suction anchorage means 28 are comprised, they will have advantageously an aspiration intake which cooperates with loop means to increase the anchorage of the tail ends 135,136 and clamping means 28 (see FIG. 14).

The plate means 33,34 may be the same as each other or differently specialized and/or dimensioned. The sizes of the plate means 33,34 and their characteristics or specialized features (of the ring means 39,40 and twisting means 41,42) may also vary when the type of yarn and/or the average length of the fibers change.

However, both of them comprise advantageously a twisting ring means 39 and 40 respectively and twisting means 41 and 42 respectively.

The ring means 39,40 are equipped with means which, by cooperating with suitable means included in the plate means 33,34, prevent the reciprocal rotation and involuntary separation thereof (see positions 433 and 139 as an example), and the same applies to the twisting means 41,42.

The twisting means 41,42 can be flat, as in FIG. 10, or be equipped with specialized processing means 50 to suit the specific requirements.

The processing means 50 are conformed advantageously in stripes with an opposite development in one half, as compared to that in the other half, of the twisting means 41 or 42.

The stripes are advantageously such as to comprise hollows between one processing means 50 and the next one so as to make evident an action of lengthwise pulling of the fibers and outer hairs of the yarns 35,36.

Intermediate clamping means 51 can be utilized in the twisting means 41 or 42. The intermediate clamping means 51 in FIG. 10 are obtained, as an example, by providing suitable recesses 141 in the disk means 41. They are obtained in FIG. 15*b* with appropriate blocks.

Auxiliary participation means 52 may also be utilized in the twisting means 41 or 42. The auxiliary participation means 52 (see the example of FIG. 15*a*) may be a set of nozzles, a heating plate or another means to suit the special auxiliary action to be carried out and the time when the action is to be carried out.

One or more auxiliary participation means 52, each with its own specialized action, may be comprised in a pair of plate means 33–34.

Thus, if it is wished to obtain an action of opening up the fibers of the remaining tail ends after the plucking action, a set of nozzles or needles or combs will be provided. If instead it is wished to fix the splice, a heating plate or a set of nozzles emitting a hot and/or treatment liquid will be provided, etc.

In a pair of plate means 33,34 at least one ring means 39–40 must be movable axially (lengthwise along the axis 18) in relation to the twisting means 41,42.

In a pair of plate means 33,34 there will be at least two studs 43 to bring the protruding yarns together.

The studs 43 may be placed either between the ring means 39 or 40 and the twisting means 41 or 42 or outside the ring means 39 or 40.

If the studs located diametrically opposite to one another are placed between the ring means 39 or 40 and twisting means 41 or 42 (see FIGS. 9 and 10), there will advantageously be in the opposite plate means an appropriate circumferential path or hollow 44 in which the studs can slide when the ring means 39,40 are face to face and pressed against each other.

The position of the ring means 39,40 and twisting means 41,42 in relation to the containers 133,134 of the plate means 33,34 respectively is a position which is advantageously elastic, and this is obtained with the thrust spring means 38.

In the lay-outs of FIG. 8 the plate means 33 solidly fixed to the gear wheel 32 comprises a container 133 with a support 233 that bears the ring means 39, and with a support 333 that bears the twisting means 41 and studs 43 which bring the yarns together.

Instead, the plate means 34 solidly fixed to the gear wheel 227 comprises a container 134 with a recess 234 (positioned on the circumference diametrically opposite so as to leave space for the yarn), wherein there is present the support 334 of the ring means 40 and twisting means 42.

Figure 8B:
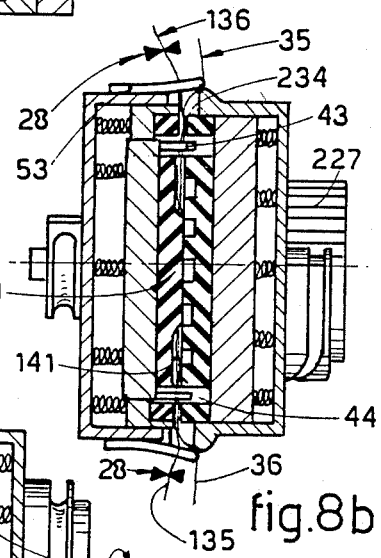
Figure 8C:
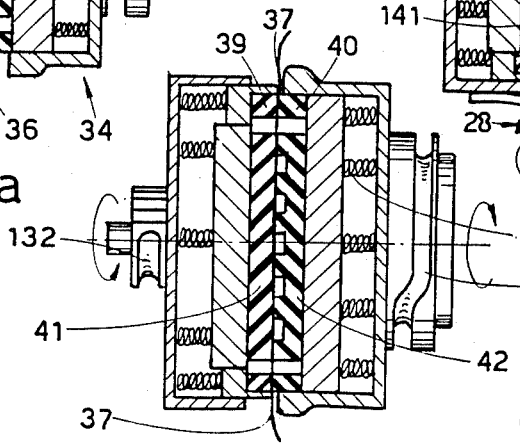

The working of the device 10 is shown diagrammatically in FIG. 8, wherein FIG. 8*a* shows the untwisting action, FIG. 8*b* shows the plucking-tearing action, FIG. 8*c* shows the retwisting action and FIG. 8*d* shows the action of the studs 43 to bring the untwisted yarns together.

When the yarns are positioned as in FIG. 7, the motion of rotation comes to the motion-input wheel 15.

The motion is advantageously continuous but could also be transmitted in a variable or pulsating manner.

The rotation of wheel 15 sets in rotation the cam 29, which acts on the working means in relation to the procedure.

The action of the cam 29 is shown in the graph of FIG. 11, which can be varied advantageously according to requirements.

The curve 48 shows that at the beginning the plate means 33 is displaced lengthwise (position 148) by a certain value, while the other plate means 34, which is also rotating, is still halted lengthwise (see curve 45).

The rotation of the plate means 33–34 is shown with the curve 46, wherein 146 shows the period in which they rotate.

The plate means 34 moves lengthwise at the moment 145 or 245 or 345 respectively or at intermediate values, depending on the required degree of untwisting, for instance, degree nil (145) where the fibers are substantially parallel at the end of untwisting, degree 50% (245) where the fibers have negative twists equal to 50% of the positive starting twists, and degree 100% (345) where the number of negative twists at the end of untwisting is about the same as the number of positive twists in the yarn at the beginning.

In the curve 45 the action of untwisting is indicated with 445, whereas the retwisting action is indicated with 545.

The curve 48 comprises the tract 148 which indicates the position of the ring 39 in FIG. 8*a*, the tract 248 which indicates the position of the ring 39 and retwisting disk means 41 in FIG. 8*b* and the tract 348 which indicates the position of the ring means 39 and retwisting means 41 in FIG. 8*c*.

The curve 47 represents the actuation of the plucking and tearing means 23, whereby 147 indicates the plucking and tearing action, 247 indicates the tract of rest and opening of the grippers for discharge of torn tails and 347 indicates the return.

As is shown in FIG. 8, substantially ring means 39,40 alone work during the untwisting phase.

At the end of the untwisting phase the studs 43 which pull the yarns have in the meantime brought the untwisted yarns together, thus making possible the action of clamping (51) and plucking or tearing thereafter and also the subsidiary and successive operations.

During the plucking and tearing phase the containers 133–134 are brought together, but the outlets 141 and 234 respectively permit the yarns to be clamped only in the tract relative to the intermediate clamping means 51.

Moreover, the means 53 that clamp the twists act so that, by pressing the yarns 35,36 elastically against the container 134 (see FIG. 8*b*), they prevent the negative twists in the yarn in the tract between the periphery of the ring means 39,40 and the intermediate clamping means 51 from being lost by spreading along the yarn outside the ring means and from being eliminated by the presence of the positive twists existing outside.

Clamping with the means 51 has the effect that the remaining tail ends have a taper which starts at a position of greatest thickness at about the edge of the intermediate clamping means 51 and reaches a position of nil thickness at about the outer side of the containers 133–134.

The ring means 39–40 and the respective retwisting means 41,42 cooperate during the retwisting phase so as to obtain the retwisting value desired.

As stated before, the conformation and sizes of the rings, or ring means, 39,40 and the conformation and sizes and special forms of the retwisting disk means, or retwisting means, 41,42 vary so as to suit the average properties of the fibers composing the yarns 35,36 to be spliced.

The obtaining of a differentiated speed of rotation as between one plate means and the other or as between a ring means and a retwisting means remains within the spirit and capabilities of the invention.

It is also within the capabilities of the invention to obtain reciprocal speeds (angular speeds if the means are circular) which are constant, or variable throughout the phases or in the individual phases, or pulsating.

We claim:

1. Procedure for splicing textile yarns mechanically whereby two yarns which are initially placed crosswise, awry or parallel to each other are first untwisted and then retwisted together utilizing two ring means comprising untwisting said yarns up to a desired value in positions of mutual noninterference, bringing together said yarns until they are substantially pressed against each other, clamping said yarn at a position lying at about the beginning of the desired taper of each remaining tail end in cooperation with said ring means so as to determine the length of said remaining tail ends, effecting a plucking-tearing action on the tails to be discharged, to obtain progressive remaining tail ends before said retwisting action, doubling and retwisting the remaining tail end by said ring means in at least two points located at least at about the ends of the splice, the action of mechanical retwisting taking place in a controlled manner from the middle of the ring means substantially up to the periphery of the same at the same time and is obtained with a mixed tangential and axial movement outwards.

2. The procedure for splicing textile yarns mechanically as in claim 1, wherein the action of bringing the yarns together takes place near the end of the untwisting phase.

3. The procedure for splicing textile yarns mechanically as in claim 1, wherein the action of bringing the untwisted yarns together takes place with the ring means interfering only partially.

4. The procedure for splicing textile yarns mechanically as in claim 1, including auxiliary undoing the yarns lying in a momentary position after the phase of untwisting and being brought together are affected in their tract by bringing the yarn between the inner sides of the ring means so that the fibers of the yarns are at least separated in respect of their normal reciprocal position.

5. The procedure for splicing textile yarns mechanically as in claim 1, wherein the tail ends are plucked and/or torn from the yarns in a controlled manner and the length of the remaining tail ends is controlled.

6. The procedure for splicing textile yarns mechanically as in claim 1, wherein the plucking-tearing action obtains in the yarns remaining tail ends of diminishing fibers beginning from about the clamping zone and stretching towards the periphery of the ring means.

7. The procedure for splicing textile yarns mechanically as in claim 1, wherein the action of retwisting the yarn mechanically with at least the tail ends doubled and controlled takes place in a manner controlled both tangentially and axially at the same time.

8. The procedure for splicing textile yarns mechanically as in claim 1, including associating an action of concentration and superficial pulling of the fibers with the mechanical retwisting action.

9. The procedure for splicing textile yarns mechanically as in claim 1, including heating the splice zone during at least part of the retwisting phase or at a moment thereafter.

10. The procedure for splicing textile yarns mechanically as in claim 1, including holding said yarns upstream from the clamping zone so as to avoid loss of the untwisting action and wherein the plucking and tearing action is carried out with the part of the yarns which is free from being affected by said action.

11. The procedure for splicing textile yarns mechanically as in claim 1, wherein the degree of untwisting of the yarns can be chosen as wished, whereby the minimum value of untwisting is at least greater than a final twist value of about nil.

12. The procedure for splicing textile yarns mechanically as in claim 1, wherein the value of the untwisting imparted to the single yarns is the same as the value of the positive twists applied to the yarns after they have been doubled.

13. The procedure for splicing textile yarns mechanically as in claim 1, wherein the value of the untwisting imparted to the single yarns is different from the value of the positive twist re-applied to the yarns after they have doubled.

14. A splicer for splicing textile yarns comprising a frame, a single pair of coaxial rings facing each other mounted on said frame to move relative to each other and between which said yarns are frictionally acted upon to be untwisted, coaxial retwisting means positioned within said rings for frictional action on said yarn, means on said retwisting means to bring the yarns together, plucking and tearing means positioned on said frame outside of said rings, clamping means on said retwisting means and drive means mounted on said frame to operate said rings, said retwisting means and said plucking and tearing means.

15. The splicer device for splicing textile yarns mechanically as in claim 14, including means to clamp the twists.

16. The splicer device for splicing textile yarns mechanically as in claim 14, including means to heat the yarns.

17. The splicer device for splicing textile yarns mechanically as in claim 14, wherein the retwisting means in cooperation with the circular rings are disk-like.

18. The splicer device for splicing textile yarns mechanically as in claim 14, wherein the intermediate clamping means are located at a desired position within, or on, the ring means and cooperate with the means which clamp the twists.

19. The splicer device for splicing textile yarns mechanically as in claim 14, wherein the ring means and retwisting means are conformed so as to leave the yarns and tail ends free in the tract not affected by the intermediate clamping means and in the tract stretching towards the plucking and tearing means when said intermediate clamping means are active.

20. The splicer device for splicing textile yarns mechanically as in claim 14, including plate means and wherein the ring means and retwisting means are supported and positioned by said plate means.

21. The splicer device for splicing textile yarns mechanically as in claim 20, wherein the plate means support the ring means and retwisting means elastically.

22. The splicer device for splicing textile yarns mechanically as in claim 20, including a gear and cam to displace lengthwise one plate means along its axis of rotation toward the other to begin the untwisting phase, and separate the plate means at the end of the retwisting phase.

23. The splicer device for splicing textile yarns mechanically as in claim 20, wherein the ring means and retwisting means in both plate means are the same.

24. The splicer device for splicing textile yarns mechanically as in claim 20, wherein the ring means and retwisting means in both plate means are not the same.

25. The splicer device for splicing textile yarns mechanically as in claim 14, wherein the retwisting means have specialized surface conformations to cause a concentration and superficial pulling of the fibers during the retwisting action.

26. The splicer device for splicing textile yarns mechanically as in claim 14, including a gear and cam to regulate untwisting.

27. The splicer device for splicing textile yarns mechanically as in claim 14, wherein at least part of the drive means consists of cams rotating through a whole circle so as to carry out a splicing cycle.

28. The splicer device for splicing textile yarns mechanically as in claim 14, wherein the plucking and tearing means exert an axial action on the tail ends within the ring means.

29. The splicer device for splicing textile yarns mechanically as in claim 14, wherein the plucking and tearing means comprise means for discharging the plucked and torn tail ends.

30. The splicer device for splicing textile yarns mechanically as in claim 14, including means to expel the spliced yarn.

31. The splicer device for splicing textile yarns mechanically as in claim 14, including means to govern the swinging of the yarn.

32. The splicer device for splicing textile yarns mechanically as in claim 14, wherein the sizes of the ring means and retwisting means are linked functionally to the properties of the fibers of the yarns to be spliced.

33. The splicer device for splicing textile yarns mechanically as in claim 14, wherein the speeds of the ring means and retwisting means are at least momentarily constant.

34. The splicer device for splicing textile yarns mechanically as in claim 14, wherein the speeds of the ring means and retwisting means are variable.

35. The splicer device for splicing textile yarns mechanically as in claim 14, wherein the speeds (angular speeds if the means are circular) of the ring means are the same as the speeds of the retwisting means at least momentarily.

36. The splicer device for splicing textile yarns mechanically as in claim 14, wherein the speeds (angular speeds if the means are circular) of the ring means are differentiated at least momentarily in respect of the speeds of the retwisting means.

37. The splicer device for splicing textile yarns mechanically as in claim 14, including means that exert a mechanical action on the two yarns positioned side by side or on the relative fibers.

38. The splicer device for splicing textile yarns mechanically as in claim 14, including means to deliver a fluid to said yarns.

* * * * *